US006309239B1

(12) United States Patent
Johnston

(10) Patent No.: US 6,309,239 B1
(45) Date of Patent: Oct. 30, 2001

(54) SAFETY COVER FOR AN ELECTRICAL RECEPTACLE

(76) Inventor: Rodney D. Johnston, 50 High St., Napanoch, NY (US) 12458

( * ) Notice: Subject to any disclaimer, the term of this patent is extended or adjusted under 35 U.S.C. 154(b) by 0 days.

(21) Appl. No.: 09/419,883

(22) Filed: Oct. 18, 1999

(51) Int. Cl.[7] ..... H01R 13/625

(52) U.S. Cl. ..... 439/373; 439/138; 439/140; 174/67

(58) Field of Search ..... 439/138, 142, 439/373, 135, 136, 137, 139, 140; 174/67, 66

(56) References Cited

U.S. PATENT DOCUMENTS

D. 331,386 * 12/1992 Koessler ..... D13/156
2,987,690 6/1961 Marbais .
3,434,618 3/1969 MacDonald .
3,639,886 2/1972 Prapkin .
4,895,999 1/1990 Calderon .
4,899,019 2/1990 Riceman .
4,915,638 4/1990 Domain .
4,952,756 * 8/1990 Meyers ..... 174/67
4,993,963 2/1991 Pedigo .
5,218,169 6/1993 Riceman .

* cited by examiner

*Primary Examiner*—Jeffrey Gaffin
*Assistant Examiner*—Truc Nguyen

(57) ABSTRACT

A safety cover for an electrical receptacle using two half covers, each of which can be slightly compressed to cause projection locks secured into slots in an inner collar about the mounting plate to withdraw thereby releasing each half door. Electrical cords are fed through openings shared by each half cover.

6 Claims, 3 Drawing Sheets

SAFETY COVER FOR AN ELECTRICAL RECEPTACLE

BACKGROUND OF THE INVENTION

1. Field of the Invention

This invention relates to safely devices and more particularly to safety devices for electrical wall outlets.

2. Prior Art and Objects

There has been a longstanding need to cover electrical outlets both when in use and when not in use. The placement of improper articles into an electrical receptacle is a major hazard for children. Plugs exist that can be inserted into an unused outlet to prevent a child from inserting an object into the receptacle. There have been numerous patents issued over the years to provide a solution to this problem. The inventions pertaining to this problem for which patents have been granted, generally sought to provide a device which could not be opened by a child but could be opened by an adult. It is critical for safety cover to be readily opened by an adult while not being capable of being opened by a child. If the safely cover is sufficiently complex to frustrate an adult who desires to open the safety cover, the device will not be used and have no benefit. Making a device which is attractive is important and of even greater importance is making a device which has sufficient simplicity so as to be economically produced. It is also important to limit the space needed by the device, particularly when it is opened. It is also important that the device be capable of being assembled into one unit, to prevent parts becoming separated from one another thereby rendering the device unusable.

The safety covers patented to date have provided covers for an electrical outlet but the complexity of certain of the safety covers and the difficulty of use as well as the space required, particularly when opened, has limited the practicality of safety covers.

The Marbais Patent, U.S. Pat. No. 2,987,690, teaches an electrical outlet cover using three pieces fit together. All three pieces are held by a pre-existing outlet plate by flanges that are held behind the plate. Obviously, the plate screw holding the plate in place must be turned down to a point were the three pieces can slide but still be retained in place. The three pieces include a center piece which must be slid into place after the tension in the plate screw is set as the center piece covers the plate screw and would thus prevent turning of the plate screw when in place. The end pieces include flanges that engage indentations in the center piece. The end pieces can be depressed to release the flanges from the indentations and the end pieces slid away from the center piece to reach the outlets. The center piece, however, would also need to be moved. The resulting operation is sufficiently complex as to cause the device not to be used. Should the retention of the plate screw be sufficiently loose, the entire cover could be slid off the cover plate even by a child. The separate pieces invite loss of a part rendering the device unusable.

The Drapkin Patent, U.S. Pat. No. 3,639,886 was not intended as a safety device but rather as an electrical receptacle cover for outdoor use to prevent water from interfering with an electrical receptacle. Drapkin, uses a split design having a longitudinal slot aligned with the major axis of the electrical receptacle. When pressure is applied to the end panels, the opening is enlarged sufficiently to provide access to the outlet. No hinges or pivoting covers is provided for by Drapkin and accessibility to the electrical receptacle appears to be restricted.

The McDonald Patent, U.S. Pat. No. 3,434,616, provides a single piece cover with various post designs to hold the cover against the wall plate. The tension of the post would have to be the controlling factor in determining whether or not a child could remove the cover. Therefore, it would not be certain that the device would be left with sufficient tension on the post to prevent turning by the child.

The Calderon Patent, U.S. Pat. No. 4,895,999, uses a variety of parts that are most apt to be lost and which require an inordinate amount of time to install. A box is held over the outlet cover in a manner similar to that used by McDonald but with openings in the face of the cover that have solid plates over the openings. Each plate has four fasteners holding it in place. When an electrical plug is installed, the solid plate is replaced by two half plates, each with semicircular openings, that mate with one another to form one circular opening. Again, the same four fasteners are needed. The mechanical work required to utilize the electrical receptacle is unduly burdensome and the loss of parts is an ultimate certainty.

Riceman, U.S. Pat. No. 4,899,019, teaches a cover with three pieces, one of which is a special wall plate to retain the other two pieces. A second piece is secured to the wall plate by flanges. The second piece includes three buttons, one on the top, one on the bottom and one on the side. A third piece mounted on hinges rotates over the second piece and has openings in it into which the three buttons fit. For the third piece to be swung open, all three buttons must be depressed together. The electrical cord passes through an opening in the second piece, which opening is sufficiently large for the cord and the plug to fit. The resulting device is complex and expensive to construct.

The Domian Patent, U.S. Pat. 4,915,638, uses a single box with a special outlet plate. The box is secured at the top to an outlet plate of special design by a lip on the box which engages a slot in the outlet plate. A cantilevered locking tab at the bottom of the box engages another slot in the locking plate. By pressing the cantilevered locking tab upwardly, the box is released. In this design only one pressure point permits the box to be removed. The box can be misplaced when removed from the locking plate can be separated.

The Pedigo Patent, U.S. Pat. No. 4,993,963, teaches a simple box hinged at one side to an outlet plate which is produced to operate with the box. Tubular fasteners on the plate match with tubular fasteners on the box so that a pin can be inserted through the tubular fasteners to retain the box in a closed position. The pin, if readily usable by an adult, would be removable by many children. Thus the protection desired would not be achieved.

Riceman, U.S. Pat. No. 5,218,169, provides a cover of a general box design which is hinged at one side edge to an outlet plate specially designed to be used in conjunction with the cover. On the opposite side from the hinge and on the top and bottom of the cover, projections are located which engage slots in the outlet plate. To open the cover, pressure must be applied in three places at one time. The use of three points of pressure might well pose some difficulty for many adults and the single cover requires room to swing open.

Accordingly, it is an object of the present invention to provide a safety cover for an electrical outlet which cannot easily be operated by a child but can be operated by an adult and which is attractive and requires minimal space to open.

It is a further object of this invention to provide a safety cover with all parts interconnected to avoid loss of parts.

It is still another object to provide a safety cover that can be economically produced and which is durable.

These and other objects and advantages of the present invention will become apparent to those of ordinary skill in the art as the description thereof proceeds.

SUMMARY OF THE INVENTION

According to the present invention, a mounting assembly is provided which replaces the standard outlet plate. The mounting assembly includes a plate which is capable of being affixed to an electrical receptacle in place of the standard outlet plate. An inner collar, which is rigid, is affixed about the plate. The mounting assembly has a longitudinal axis which is the centerline along the longest length of the mounting assembly. A pair of half covers are located on opposite sides of the longitudinal axis. Each half cover is generally a mirror image of the other half cover. The half covers are mounted on the mounting assembly by hinges. Locking means are provided to lock each half cover to the inner collar. Each half cover is slightly deformable so that when pressed, the locking means is released. The spread of the hand required to compress the half cover is sufficiently large to prevent compression by a child and with two hands, insufficient pressure could be applied by a child.

DESCRIPTION OF THE DRAWINGS

The invention may be readily understood by referring to the accompanying drawings, in which.

DESCRIPTION OF THE PREFERRED EMBODIMENT

Figure 1:
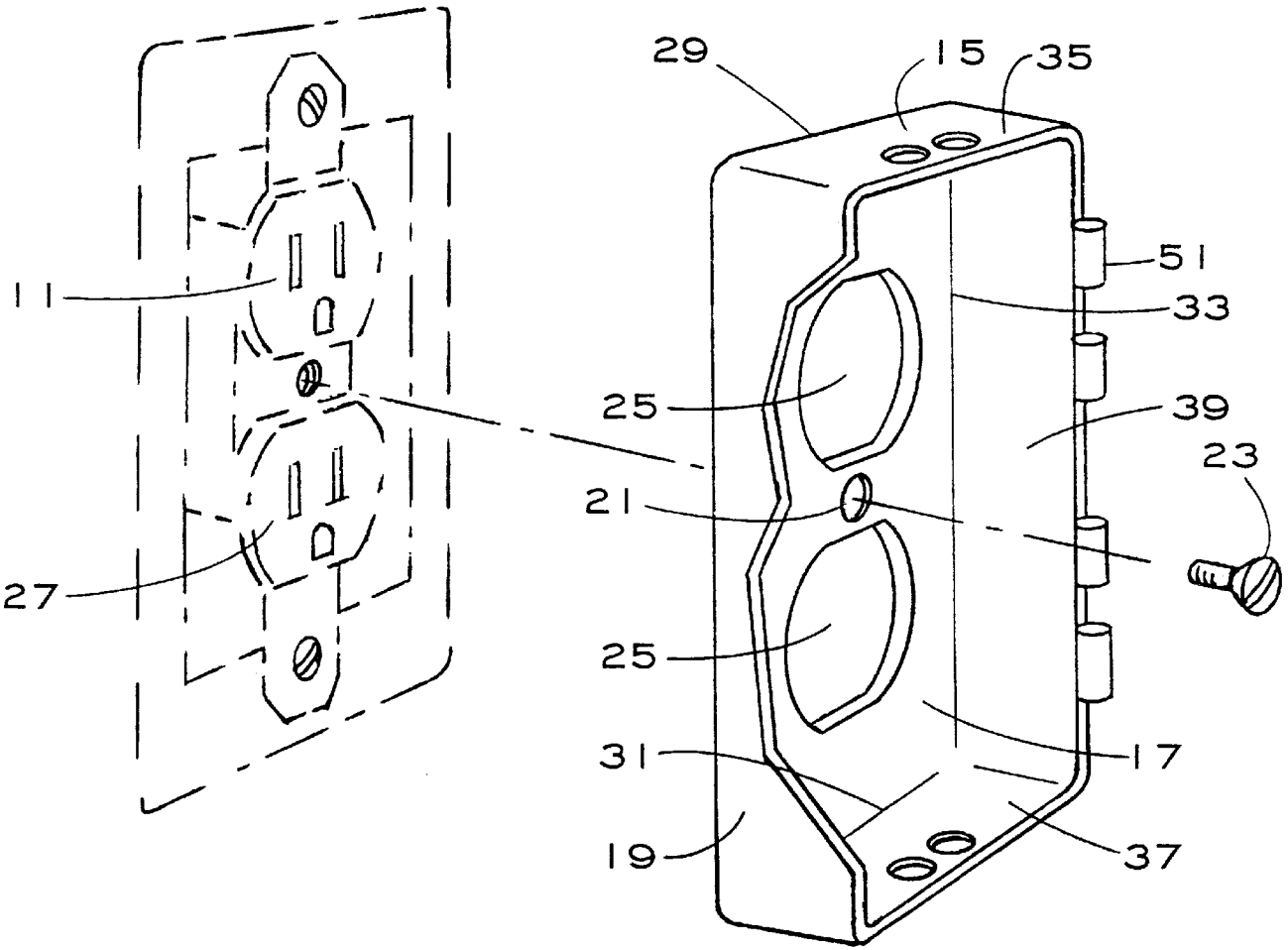
FIG. 1 is a pictorial exploded view of the electrical receptacle with the mounting assembly.
Figure 2A:
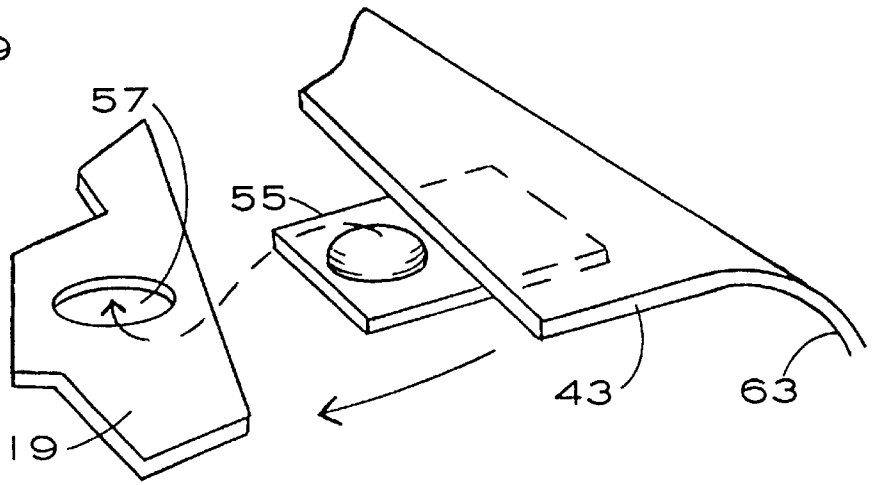
FIG. 2 is a pictorial view of the right side (as faced) of the safety cover showing a half cover open on hinges mounted on the mounting assembly.
Figure 2:
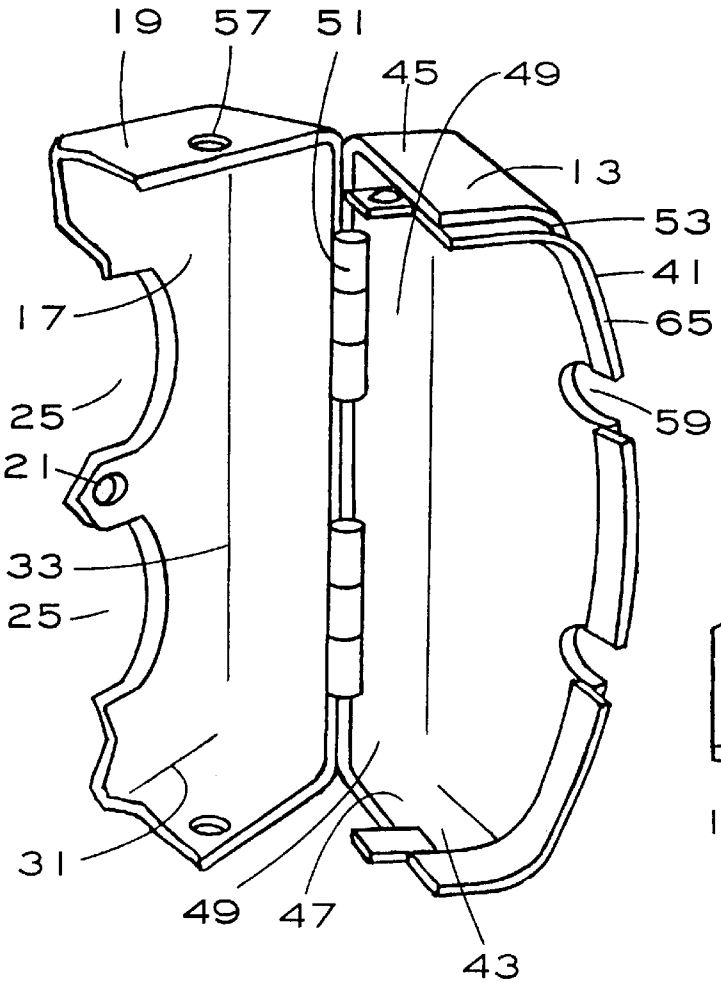
Figure 3:
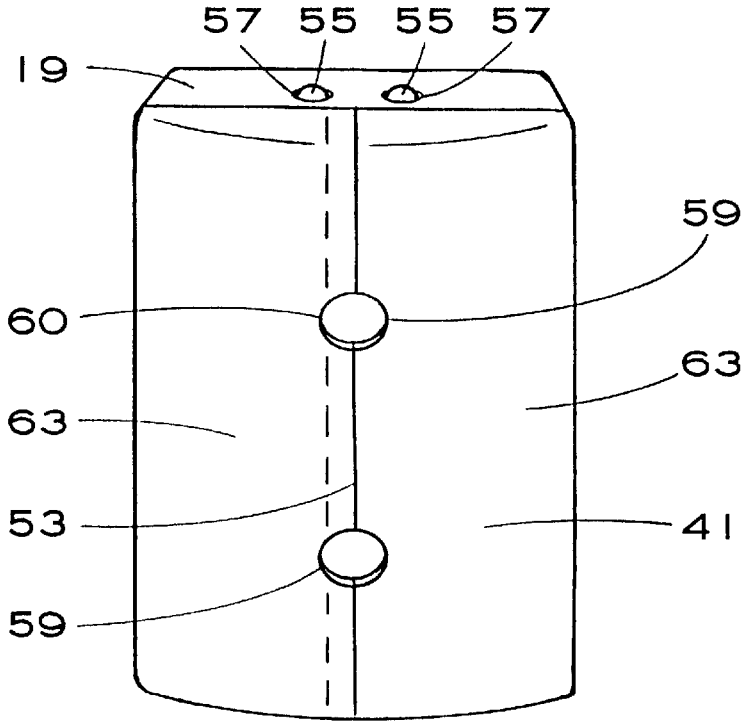
FIG. 3 is a pictorial view of the front of the safety cover with the half covers closed on the mounting assembly.
Figure 4:
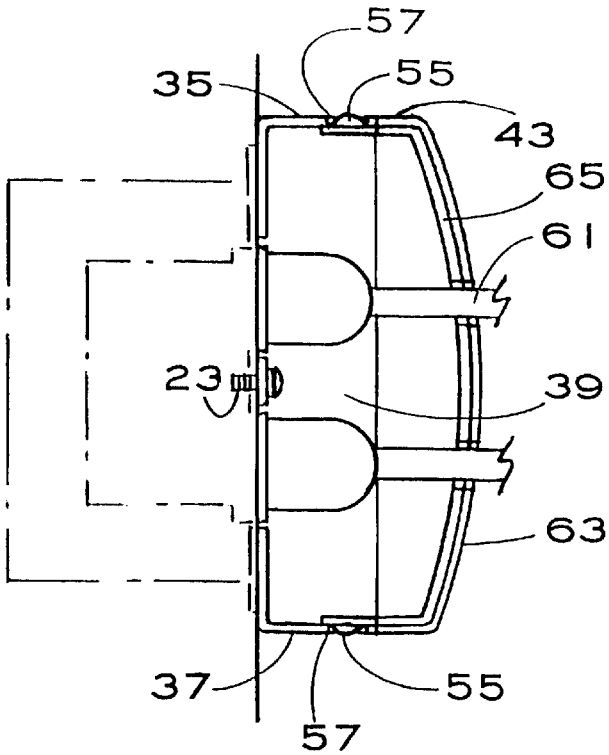
FIG. 4 is a sectional view of the safety cover along the longitudinal axis of the mounting assembly.

A safety cover for an electrical receptacle 11 is provided that can be readily accessed by an adult but cannot be opened by a small child. Two half covers 13 close over the electrical receptacle 11 so as to prevent access to the electrical receptacle 11 by a child while also providing a pleasing appearance. The two half covers 13 may be opened in half the available distance from the wall required by a single cover.

A mounting assembly 15 is mounted on the electrical receptacle 11 in place of a standard plate used to decorate an electrical receptacle 11. The mounting assembly 15 includes a mounting plate 17 and an inner collar 19 affixed to one another or formed together. The mounting plate 17 is capable of being mounted on the electrical receptacle 11 and thus must have an opening 21 for a mounting screw 23 used to mount standard plates on electrical receptacles 11 and also have outlet openings 25 that frame the outlets 27 of the electrical receptacle 11. The mounting plate 17 has a top edge 29, a bottom edge 31 and two side edges 33. The inner collar 19 surrounds the mounting plate 17 along the top edge 29, bottom edge 31 and two side edges 33 and has a top section 35, a bottom section 37 and two side sections 39. The top section 35, the bottom section 37 and the two side sections 39 extend from the top edge 29, bottom edge 31 and two side edges 33 of the mounting plate 17 at essentially right angles to the mounting plate 17. The mounting assembly 15 has a longitudinal axis which is the centerline of the mounting assembly 15 along the longest length or major axis of the mounting assembly 15.

A cover assembly 41 which is mounted on the inner collar 19 includes the two half covers 13. The two half covers 13 are essentially mirror images of one another. The two half covers 13 are mounted on opposite sides of the longitudinal axis. Each half cover 13 includes an outer collar 43. The outer collars 43 adjoin the inner collar 19 when the half covers 13are closed and are aligned with the inner collar 19, and together, leaving room for clearance between the two half covers 13, essentially match the configuration of the inner collar 19. Each outer collar 43 of each half cover 13 also has a top section 45, a bottom section 47 and two side sections 49. The top sections 45 and the bottom sections 47 of the outer collars 43 align with the top section 35 and bottom section 37 respectively of the inner collar 19. Similarly, the two side sections of the inner collar 19 aligns with the side sections 49 of the outer collars 43. Between the two side sections 39 of the inner collar 19 and the two side sections 49 of the outer collars 43, a pair of hinges 51 are located. The hinges 51 may be separate hinges 51 or may be a folding line of material which is capable of repeated rotation of the half covers 13 without breaking. If such a folding line is used rather than an interlocking hinge with a pin for a hinge 51, the entire safety cover may be molded in one piece.

The two half covers 13 meet at the longitudinal axis of the safety cover and the two edges of the half covers 13 that meet one another are referred to herein as the longitudinal edges 53. To secure the half covers 13in place, locking projections 56 are mounted on each half cover 13 along the top section 45 and the bottom section 47 of the outer collar 43. Each locking projection 55 is an L-shaped elongated member extending under the inner collar 19 and turning up into the inner collar 19. Lock openings 57 are formed in the inner collar 19 which are engaged by the locking projection 55 when the respective half cover 13 is closed.

Two semicircular openings 59 are formed along the longitudinal edge 53 of both half covers 13. The semicircular openings 59 on the two half covers 13 oppose one another to form two circular openings 60 through which can pass the electrical cord 61 of any electrical device plugged into the electrical receptacle 11 being covered. The circular openings 60 are located in spaced relationship to one another and generally equidistant from the top section 45 and the bottom section 47 of the outer collar 43.

A front surface 63 extends from the top section 45, bottom section 47 and side section 49 of the outer collar 43 to the longitudinal edge 53. Preferably, the front surface 63 has an arcuate shape which extends outwardly from the mounting assembly 15 as it extends from the side section 49 and top section 45 and bottom section 47 of the outer collar 43. As a result, the portion of the two half covers 13 about the two circular openings 60 is farthest from the mounting assembly 15. The arcuate shape provides a pleasing appearance and the necessary space under the half covers 13 to accommodate any electrical plugs using the electrical receptacle 11.

To provide greater strength for the half covers 13, a lip 65 is mounted on one of the half covers 13 along the longitudinal edge 53 without obstructing the circular openings 60.

The inner collar 19 is rigidly constructed. The half covers 13, although strong and durable, have sufficient flexibility so that when the top section 45 and the bottom section 47 of the outer collar 43 are forced together, each half collar 13 will compress sufficiently to permit its respective locking projections 55 on that half cover 13 to withdraw from the lock openings 57 in the inner collar 19 thereby permitting that half cover 13 to be opened. Since only half covers 13 are opened, when the half covers 13 are fully opened, the distance from the mounting assembly 15 is half of the distance from the mounting assembly 15 that a full door would use. Also, effectively to reach the electrical plugs mounted in the electrical receptacles 11, both half covers 13 need to be opened requiring the compression of a half cover 13 to be performed twice. The length of each half cover 13 from the top section 45vof the outer collar 43 to the bottom section 47 of the outer collar 43 is of sufficient size to prevent a child from opening the safety cover due to inadequate hand size as well as the strength needed to compress the half cover 13 with two hands. As a result, the electrical receptacle 11 is protected from intrusion by a child by can be opened easily by an adult. The space required in front of the half covers 13 to open both half covers 13 is maintained at a minimum. An attractive cover is also provided when the half covers 13 are closed.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. A safety cover for an electrical receptacle, comprising:

a mounting assembly having a longitudinal axis and including a mounting plate capable of being affixed to an electrical receptacle and an inner collar affixed around the plate, the inner collar being rigid and the longitudinal axis being the longest axis;

a pair of half covers, each half cover being on opposite sides of the longitudinal axis and each half cover generally being a mirror image of the other half cover, each half cover including:

an outer collar, each outer collar being aligned with the inner collar and having an inner edge adjacent to the inner collar and having an outer edge; and a front member extending from the outer edge of each outer collar and having a longitudinal edge along the longitudinal axis;

a lip mounted along the longitudinal edge of the front member on one half cover and extending behind the other half cover;

hinge means for mounting each half cover on the mounting assembly; and means for locking the half covers to the inner collar, the half covers being sufficiently deformable to release the locking means.

2. A safety cover for an electrical receptacle according to claim 1 wherein the means for locking the half covers includes a pair of locking projections mounted on each half cover of the pair of half covers.

3. A safety cover for an electrical receptacle according to claim 1 wherein each half cover has an outer collar, each outer collar being aligned with the inner collar and having an inner edge adjacent to the inner collar.

4. A safety cover for an electrical receptacle, comprising:

a mounting assembly having a longitudinal axis and including a mounting plate and an inner collar, the mounting plate having a top edge, a bottom edge and two side edges and being capable of being affixed to an electrical receptacle and the inner collar being rigid and being affixed to the plate and extending generally at right angles to the mounting plate;

a cover assembly including two half covers, each half cover generally being a mirror image of the other half cover and each half cover being located on opposite sides of the longitudinal axis of the mounting assembly, the longitudinal axis being the longest axis, each half cover being slightly deformable, each half cover including:

an outer collar, each outer collar being aligned with the inner collar and having an inner edge adjacent to the inner collar and having an outer edge, and a front member extending from the outer edge of each outer collar and having a longitudinal edge along the longitudinal axis, each front member having a pair of semicircular openings along the longitudinal edge, the semicircular openings on one front member being aligned with the semicircular openings on the other front member;

a lip mounted along the longitudinal edge of the front member on one half cover and extending behind the other half cover;

a hinge means mounted between the outer collars and one of the side edges of the inner collar; and a pair of locking projections extending from each outer half collar, each inner collar having two pairs of lock openings in which the locking projections lock when each half cover is closed against the inner collar, each outer collar being flexible, the locking projections being withdrawn from the lock opening when the outer collar of a half cover is compressed between the locking projections.

5. A safety cover for an electrical receptacle according to claim 1 wherein each front member has a pair of semicircular openings along the longitudinal edge, the semicircular openings on one front member being aligned with the semicircular openings on the other member.

6. A safety cover for an electrical receptacle according to claim 4 wherein the pair of locking projections are adjacent the longitudinal edge and one locking projection of the pair of locking projections is on the bottom section of the outer collar and the other locking projection of the pair of locking projections is on the top of the outer collar.

* * * * *